US007014013B2

(12) United States Patent
Fujita

(10) Patent No.: US 7,014,013 B2
(45) Date of Patent: Mar. 21, 2006

(54) GUIDING DEVICES OF ELEVATOR

(75) Inventor: Yoshiaki Fujita, Fuchu (JP)

(73) Assignee: Toshiba Elevator Kabushiki Kaisha, Shinagawa-ku (JP)

( * ) Notice: Subject to any disclaimer, the term of this patent is extended or adjusted under 35 U.S.C. 154(b) by 0 days.

(21) Appl. No.: 11/209,689

(22) Filed: Aug. 24, 2005

(65) Prior Publication Data

US 2005/0279588 A1 Dec. 22, 2005

Related U.S. Application Data

(63) Continuation of application No. PCT/JP2004/010443, filed on Jul. 15, 2004.

(30) Foreign Application Priority Data

Aug. 8, 2003 (JP) ..... 2003-290863

(51) Int. Cl.
*B66B 1/34* (2006.01)

(52) U.S. Cl. ..... 187/292; 187/393

(58) Field of Classification Search ..... 187/292, 187/391, 393, 394, 409, 410, 277, 293, 295, 187/296

See application file for complete search history.

(56) References Cited

U.S. PATENT DOCUMENTS 4,995,478 A * 2/1991 Oshima et al. ..... 187/292
5,308,938 A 5/1994 Roberts et al.
5,402,861 A * 4/1995 Kohara ..... 187/292
5,535,853 A * 7/1996 Skalski ..... 187/410
5,542,501 A * 8/1996 Ikejima et al. ..... 187/292
5,749,444 A 5/1998 Skalski
6,401,872 B1 6/2002 Morishita
2001/0037916 A1 11/2001 Morishita

FOREIGN PATENT DOCUMENTS

GB 2 262 932 A 7/1993
JP 5-178562 A 7/1993
JP 2616527 B2 3/1997
JP 2889404 B2 2/1999

* cited by examiner

*Primary Examiner*—Jonathan Salata
(74) *Attorney, Agent, or Firm*—Foley & Lardner LLP

(57) ABSTRACT

A device, which is provided at a car, for guiding the car along guide rails, the device comprises, a non-contact type of actuator configured to generate a magnetic force which keeps the actuator away from surfaces of a rail by predetermined distances, a unit configured to detect a distance between the rail and the car, a unit configured to determine an amount of displacement of the rail which is caused by a load which generates at time of guiding, based on a value of the magnetic force and the distance, a unit configured to acquire position information regarding the car, a unit configured to calculate an amount of a warp occurring at time of setting the rail, which corresponds to the information, and a unit configured to control the magnetic force based on a total value of the determined amount of the displacement and the amount of the warp.

12 Claims, 6 Drawing Sheets

GUIDING DEVICES OF ELEVATOR

CROSS-REFERENCE TO RELATED APPLICATIONS

This is a Continuation Application of PCT Application No. PCT/JP2004/010443, filed Jul. 15, 2004, which was published under PCT Article 21(2) in English.

This application is based upon and claims the benefit of priority from prior Japanese Patent Application No. 2003-290863, filed Aug. 8, 2003, the entire contents of which are incorporated herein by reference.

BACKGROUND OF THE INVENTION

1. Field of the Invention

The present invention relates to guiding devices of an elevator, which guide a car thereof to be traveled.

2. Description of the Related Art

In recent years, elevators have been made to travel at higher speed toward ultrahigh speed, as higher buildings have been constructed as skyscrapers. However, when an elevator travels at ultrahigh speed, it is influenced by the speed of wind in a hoistway, vibration of a main rope, and variable loads such as its compensating rope and a tail cord, etc., and vibration of a car is caused. This has a great influence on the riding comfort of the elevator which is one of the functions thereof.

Thus, in order to improve the riding comfort, some elevator machines have been proposed.

In a proposed elevator machine, on a car side, contact type of guiding devices and non-contact type of guiding devices are provided, the contact type of guiding device guiding a car while contacting guide rails at all times, the non-contact type of guiding devices having electromagnets which guide the car while being located opposite to the guide rails such that they are in non-contact with the guide rails. The magnetic forces from the electromagnets are varied to restrict lateral vibration applied to the car, thereby improving the riding comfort. This technique is disclosed in, e.g., Japanese patent No. 2616527.

In another proposed elevator machine, on a car side, electromagnets are provided such that each of them is in non-contact with a guide rail from three directions, and lateral vibration of a car at a regular operation time is detected. If the lateral vibration is great, a control instruction is corrected to reduce the lateral vibration. At a subsequent operation time of the elevator, the electromagnets are controlled by using the corrected control instruction, thereby restricting the lateral vibration of the elevator. This technique is disclosed in, e.g., Jpn. Pat. Appln. KOKAI Publication No. 5-178562.

A further proposed elevator machine is a car-stabilizing machine for stabilizing the riding comfort of a car. The stabilizing machine detects the acceleration of the car in the horizontal direction, and controls actuators based on the detected acceleration, thereby restricting horizontal variation of the car. This technique is disclosed in, e.g., Japanese patent No. 2889404.

Therefore, the above elevator machines can be achieved such that they are relatively light and compact, as in general guiding devices which guide a car while their rollers are in contact with guide rails at all times.

However, such contact type of guiding devices as disclosed in Japanese patent No. 2616527 are intended to restrict lateral vibration applied to a car, while contacting guide rails at all time. They are also influenced by dynamic deformation of the guide rails which is caused by warping of the guide rails and partial loads, etc. generating when the elevator travels.

Further, such a machine as disclosed in Jpn. Pat. Appln. KOKAI Publication No. 5-178562 detects lateral vibration of a car at a regular operation time, corrects a control instruction based on the detected value, and applies it to a subsequent operation, as a result of which it is prevented from being influenced by guide rails not regularly set. However, it cannot be prevented from being influenced by dynamic deformation of the guide rails which is caused by partial loads, etc. when the elevator travels while its traveling state varies momently.

Furthermore, such a machine as disclosed in Japanese patent No. 2889404 is formed to detect lateral vibration of a car, and perform a feedback control on actuators. In this machine, great forces for controlling vibration must be generated from the actuators, since the object to be controlled in vibration by the machine is the entire car. Accordingly, the machine cannot be expected to sufficiently control vibration.

In addition, it can be considered that warps in guide rails are stored in advance, and a feedforward control is carried out on an estimation-preceding basis based on the traveling position of the car. However, such a method cannot be expected to sufficiently control vibration, since dynamic deformation of the guide rails, which is caused by partial loads when the elevator travels, also occurs.

BRIEF SUMMARY OF THE INVENTION

According to an embodiment of the present invention, a guiding device of an elevator, which is provided at a car to be made to ascend/descend in a hoistway, for guiding the car along guide rails arranged on both sides of the hoistway, the guiding device comprising: a non-contact type of actuator configured to generate a magnetic force which keeps the actuator away from surfaces of a guide rail by predetermined distances, a distance detecting unit configured to detect a distance between the guide rail and the car, a unit configured to determine an amount of displacement of the guide rail which is caused by a load which generates at time of guiding the car, based on a value of the magnetic force generated by the actuator and the distance detected by the distance detecting unit, a unit configured to acquire present position information regarding the car, a unit configured to calculate an amount of a warp occurring at time of setting the guide rail, which corresponds to the acquired present position information, and a control unit configured to control the magnetic force generated by the actuator based on a total value of the determined amount of the displacement and the amount of the warp.

According to an embodiment of the present invention, a guiding device of an elevator, which is provided at a car to be made to ascend/descend in a hoistway, for guiding the car along guide rails arranged on both sides of the hoistway, the guiding devices comprises a non-contact type of actuator configured to generate a magnetic force which keeps the actuator away from surfaces of a guide rail by predetermined distances, a distance detecting unit configured to detect a distance between the guide rail and the car, an active guide mechanism which includes units configured to press respective rollers against the surfaces of the guide rail by using elastic forces of elastic members, and displacement detecting units configured to detect displacement of the elastic members, a unit configured to determine an amount of displacement of the guide rail which is caused by a load, based on a value of the magnetic force generated by the actuator, the distance detected by the distance detecting unit, and amounts of the displacement detected by the displacement detecting units, a unit configured to acquire present position information regarding the car, a unit configured to calculate an amount of a warp occurring at time of setting the guide rail, which corresponds to the acquired present position information, and a control unit configured to control the magnetic force generated by the actuator based on a total value of the amount of the displacement and the amount of the warp.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

The embodiments in the case where the present invention is applied to an elevator will be explained with reference to the accompanying drawings.

The First Embodiment

Figure 1:
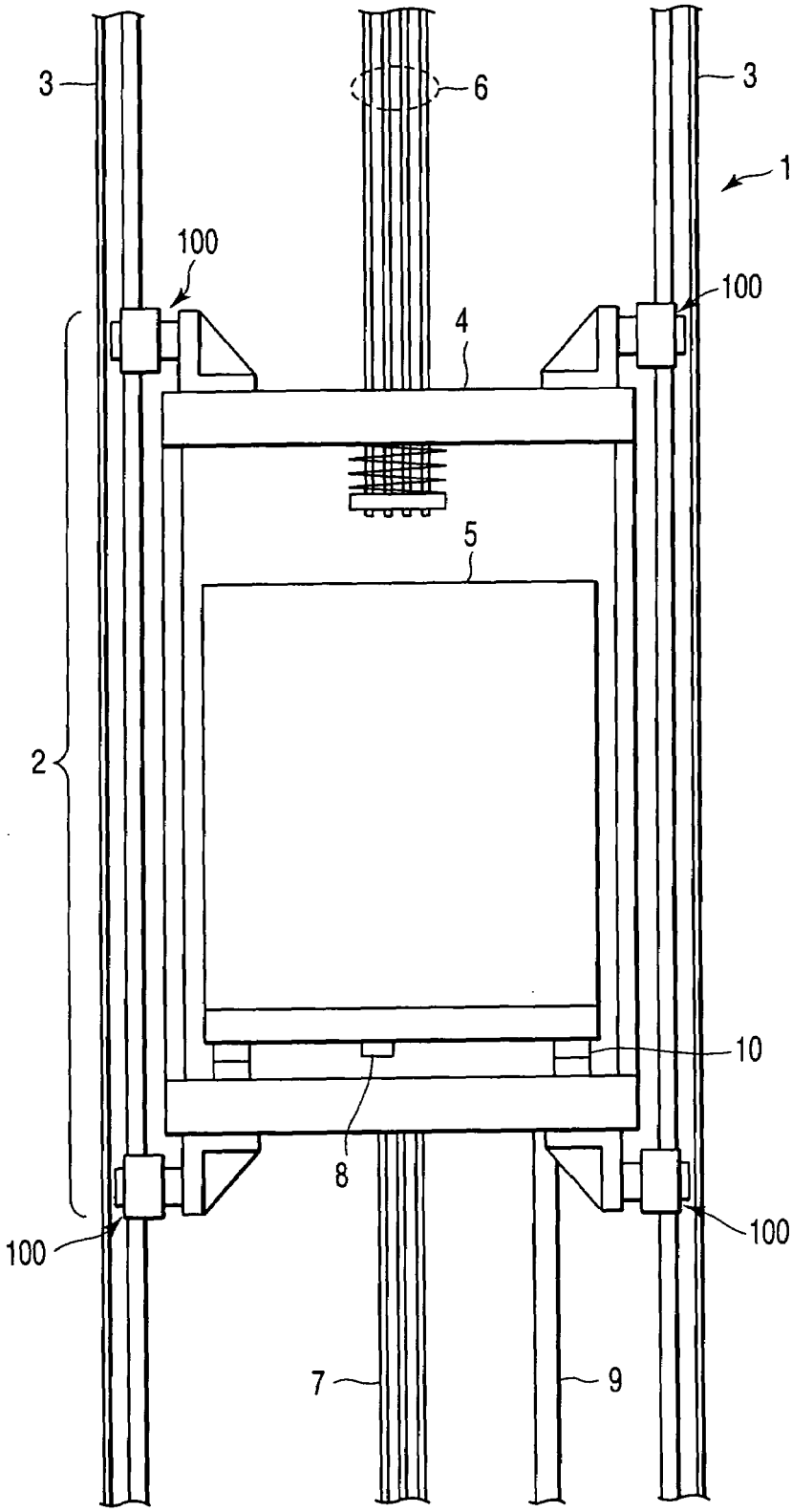
FIG. 1 is a view showing an example of the structure according to the first embodiment of the present invention.

FIG. 1 is a view showing an example of the structure according to the first embodiment of the present invention.

In an elevator shown in FIG. 1, a car 2 is provided in a hoistway 1. The elevator has a structure in which the car 2 is made to ascend/descend along guide rails 3 located on the both sides of the hoistway 1.

The car 2 has a car frame 4 and a car room 5. The car frame 4 comprises left and right vertical frames as a pair of frames and upper and lower beams which are horizontally provided between upper ends of the vertical frames and between lower ends thereof, respectively. The car room 5 is used to carry passengers to a destination floor. Furthermore, the car 2 is provided to hang on one end side of a main rope 6. The main rope 6 is wound around a main sheave (not shown) of a hoisting machine. In addition, the elevator shown in FIG. 1 comprises a compensating rope 7, an acceleration sensor 8, a tail cord 9 and a load detecting sensor 10.

In the elevator having the above structure, non-contact guiding devices 100 are attached to four portions of the car frame 4, i.e., upper left and right and lower left and right portions thereof. The non-contact guiding devices 100 can be kept away from the guide rolls 3 by a constant distance.

Figure 2:
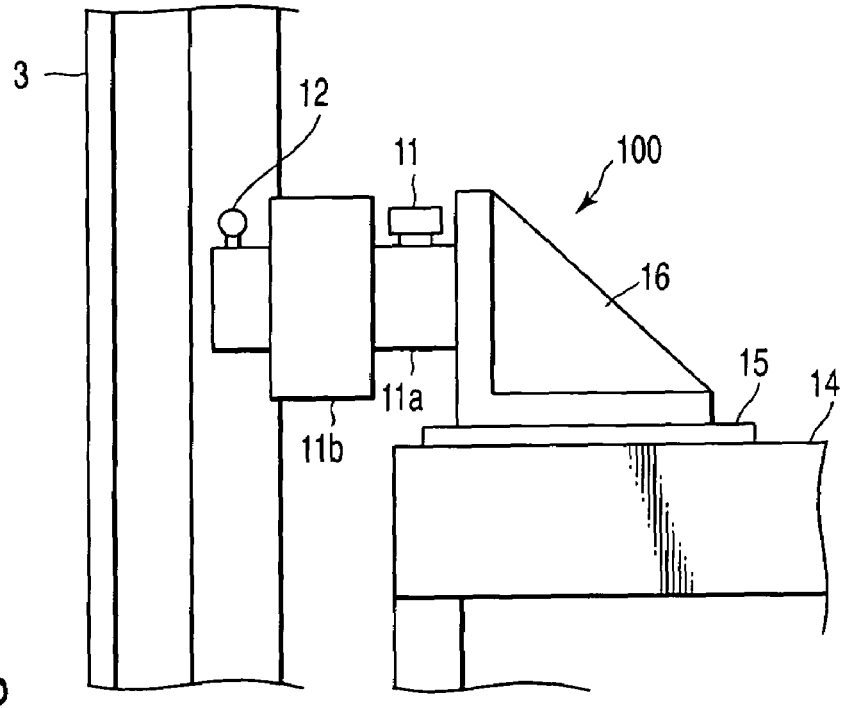
FIG. 2 is a side view of an example of each of non-contact guiding devices 100 in an elevator according to the first embodiment of the present invention.

FIG. 2 is a side view of an example of each of non-contact guiding devices 100 in an elevator according to the first embodiment of the present invention.

Figure 3:
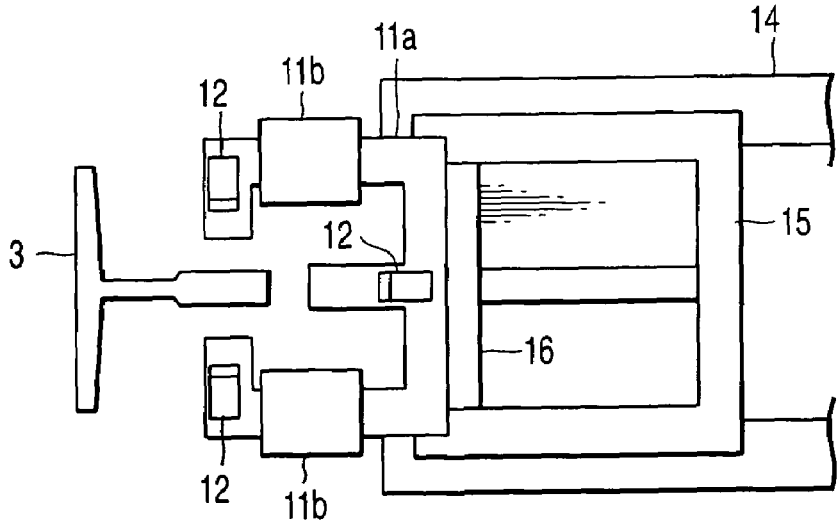
FIG. 3 is a plan view of the example of each non-contact guiding device 100 in the elevator according to the first embodiment of the present invention.

FIG. 3 is a plan view of the example of each non-contact guiding device 100 in the elevator according to the first embodiment of the present invention.

Figure 4:
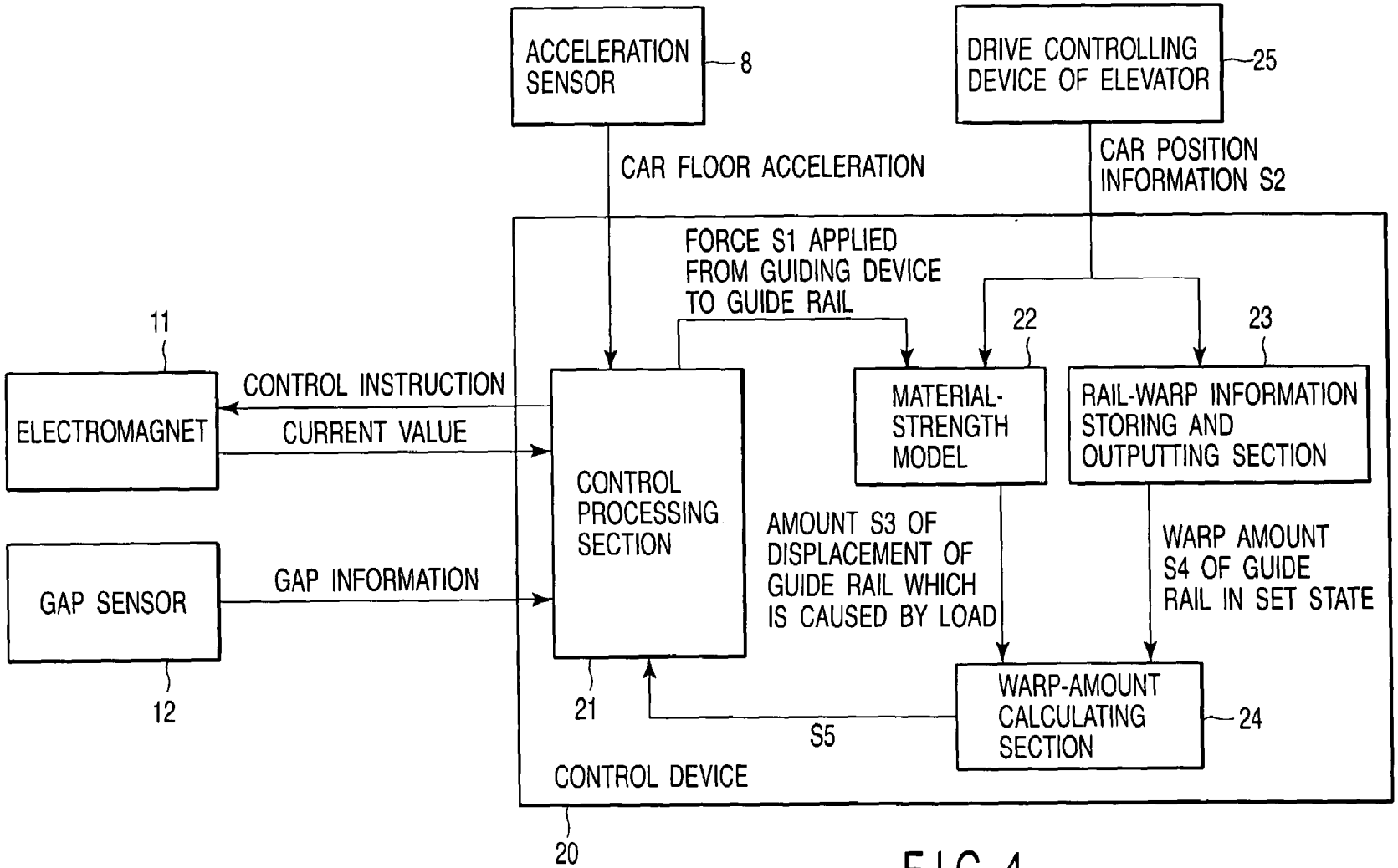
FIG. 4 is a block diagram showing examples of various kinds of devices provided in each non-contact guiding device 100 in the elevator according to the first embodiment of the present invention.

FIG. 4 is a block diagram showing examples of various kinds of devices provided in each non-contact guiding device 100 in the elevator according to the first embodiment of the present invention.

Each non-contact guiding device 100, as shown in FIGS. 2 and 3, comprises an electromagnet 11 functioning as an actuator, gap sensors 12 for detecting the sizes of gaps between the electromagnet 11 and the guide rail 3, and a control device 20, shown in FIG. 4, for controlling the magnetic force of the electromagnet 11. That is, the non-contact guiding device 100 controls the attraction of the electromagnet 11, and balances attracting forces which are applied in opposite directions by the electromagnet 11, whereby it is kept away from the guide rail 3 by a constant distance.

Furthermore, the electromagnets 11 are fixed to supporting members 16. The supporting members 16 are provided on upper portions of base plates 15 of the upper left and right portions and lower left and right portions of the car frame 4 such that they are located opposite to surfaces of the guide rails 3. The electromagnets 11 each include an E-shaped core 11*a* and coils 11*b*. The E-shaped core 11*a* is set to face three faces of the guide rail 3 such that it is separated from the faces by given distances. The coils 11*b* are wound around core pieces of the both sides of the E-shaped core 11*a*.

The gap sensors 12 are non-contact type of distance sensors, and are provided to have equivalent relationships in distance with the three faces of the guide rail 3 and to correspond to the core pieces.

In the control device 20, as shown in FIG. 4, a control processing section 21, a material-strength model 22, a rail-warp information storing and outputting section 23 and a warp-amount calculating section 24. The control processing section 21 is a unit for calculating a force S1 applied to the guide rail 3 by using information regarding current flowing through the electromagnet 11 and gap information regarding the gaps between the guide rail 3 and the electromagnet 11, which is sent from the gap sensor 12. The material-strength model 22 is a material-strength model of the guide rail 3, and calculates and outputs the amount of displacement of the guide rail 3 in the present position of the car 2, which is caused by a load generating when the guide rail 3 guides the car 2.

The rail-warp information storing and outputting section 23 stores the warp amount of the guide rail 3 at the time of setting. The warp-amount calculating section 24 is provided in the control processing section 21 or outside the control processing section 21 as shown in FIG. 4, and calculates the final warp amount of the guide rail 3.

Next, the operation of the guiding device 100 in the elevator according to the first embodiment of the present invention will be explained.

First, in the material-strength model 22, for example, a section secondary moment of the guide rail 3, the modulus of elasticity of the guide rail 3 and information regarding the distance between adjacent fulcrums supporting the guide rail 3 at, e.g., a hoistway wall, etc. are stored, which are necessary to calculate the amount of displacement due to a load which generates when the guide rail 3 guides the car 2.

When the car 2 is operated based on an operation instruction from a drive controlling device 25 of the elevator, the control processing section 21 of the control device 20 calculates the force S1 applied from the electromagnet 11 to the guide rail 3 based on information regarding the value of current flowing in the electromagnet 11 and gap information regarding the gaps between the guide rail 3 and the electromagnet 11, measured by the gap sensor 12, and outputs the result of calculation to the material-strength model 22.

Present position information S2 regarding the present position of the car 2, which is output from the drive controlling device 25 of the elevator, is input to the material-strength model 22. Therefore, the material-strength model 22 calculates the amount S3 of displacement of the guide rail 3 in the present position of the car 2, which is caused by a load generated at the time of guiding the car 2, according to the general model type of the strength of materials, by using the present position information S2 regarding the car 2, the force S1 and the section secondary moment of the guide rail 3, modulus of the elasticity and information regarding the distance between the fulcrums, which are already stored in the material-strength model 22. It then outputs the result of calculation to the warp-amount calculating section 24.

At this time, the present position information S2 regarding the present position of the car 2 is momently input from the drive controlling device 25 to the rail-warp information storing and outputting section 23. Thus, the rail-warp information storing and outputting section 23 reads out the warp amount S4 at the time of setting the guide rail 3, which corresponds to the present position information S2, and sends it to the warp-amount calculating section 24.

The warp-amount calculating section 24 calculates a warp amount which is the sum of the displacement amount S3 of the guide rail 3, which is output from the material-strength model 22, and the warp amount S4 output from the rail-warp information storing and outputting section 23, i.e., it calculates the warp amount S5 of the guide rail 3 in the present position of the car 2, and then outputs the result of calculation to the control processing section 21.

The control processing section 21 gives the electromagnet 11 a control instruction according with the warp amount S5 input from the warp-amount calculating section 24, thereby controlling the magnetic force of the electromagnet 11.

Therefore, the control device 20 calculates the sum of the displacement amount S3 of displacement due to the variation of the load and the warp amount S4 at the rail setting time, and the magnetic force of the electromagnet 11 based on the result of calculation. It can thus control the magnetic force of the electromagnet 11 while considering the absolution position of the car in the horizontal direction, in addition to the relative position of the car 2 to the guide rail 3. Therefore, the position of the car 2 in the horizontal direction can be always kept fixed. Accordingly, an elevator can be achieved which does not cause vibration, and which is good with respect to riding comfort.

The control device 20 estimates in advance the static warp amount S4 of the guide rail 3 in the set state, and the dynamic displacement amount S3 of the guide rail 3 in the operating state of the car 2, and performs a feedforward control on the electromagnet 11 based on the result of estimation, thereby reliably maintaining the absolute position of the car 2 in the horizontal direction. This control can always keep the position of the car 2 in the horizontal direction fixed, by using a small magnetic force, unlike a control for restricting vibration of the car 2, which is caused by warping of the guide rail 3, after occurrence of the vibration. Thus, the size of the electromagnet 11 can be decreased, and the power consumption can also be lowered.

As shown in FIG. 1, an acceleration sensor 8 is provided close to a floor of the car room 5. By the acceleration sensor 8, a car floor acceleration signal, which is a signal indicating the variation of the speed of the car 2 with time in the horizontal direction, is obtained, and input to the control processing section 21. In this case, when a feedback control for restricting vibration occurring at the car 2 is combined with the above feedforward control, vibration of the car 2 can be further restricted. Thus, the achieved elevator further improves the riding comfort.

The Second Embodiment

Figure 5:
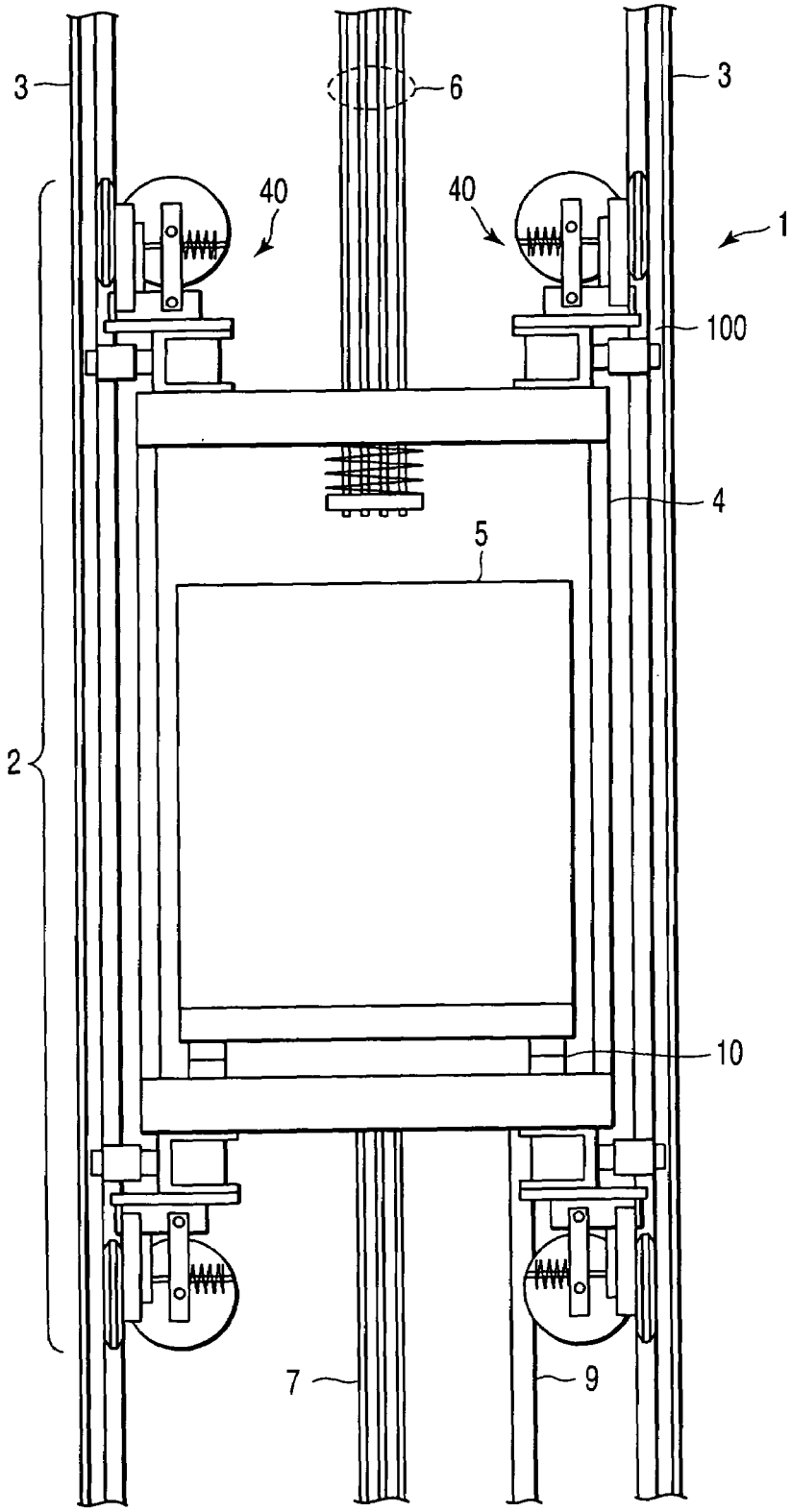
FIG. 5 is a view showing an example of the entire structure of the elevator according to the second embodiment of the present invention.

FIG. 5 is a view showing an example of the entire structure of the elevator according to the second embodiment of the present invention. It should be noted that with respect to FIG. 5, explanations of the same portions as in FIG. 1 or portions equivalent to corresponding portions in FIG. 1 will be omitted.

In the elevator according to the second embodiment of the present invention, non-contact guiding devices 100 and active guide mechanisms 40 are provided.

The non-contact guiding devices 100 comprise electromagnets 11, gap sensors 12 and control devices 20 for controlling the magnetic forces of the electro-magnets 11, etc., and the active guide mechanisms 40 include mechanisms which contact guide rails 3.

Figure 6:
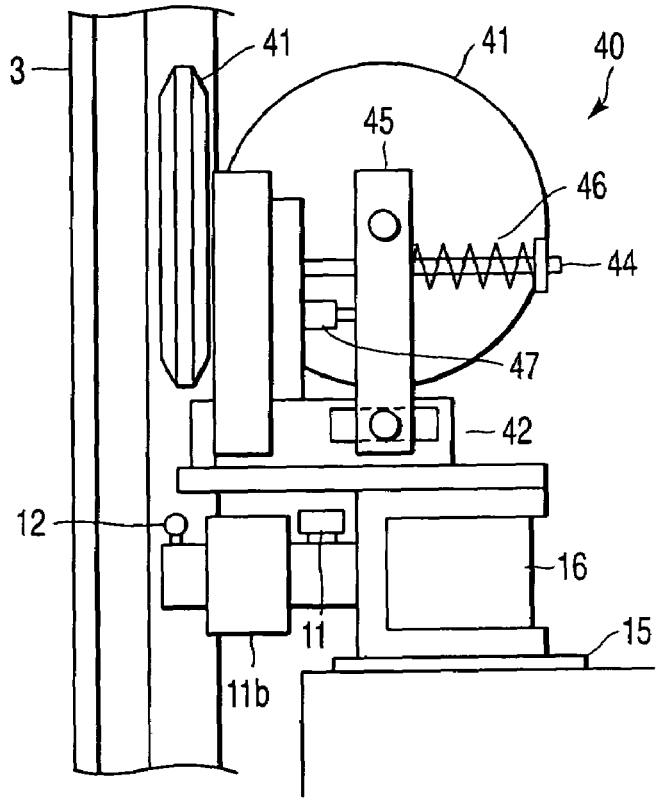
FIG. 6 is a side view specifically showing examples of each of the active guide mechanisms 40 and each of the guiding devices 100 in the elevator according to the second embodiment of the present invention.
Figure 7:
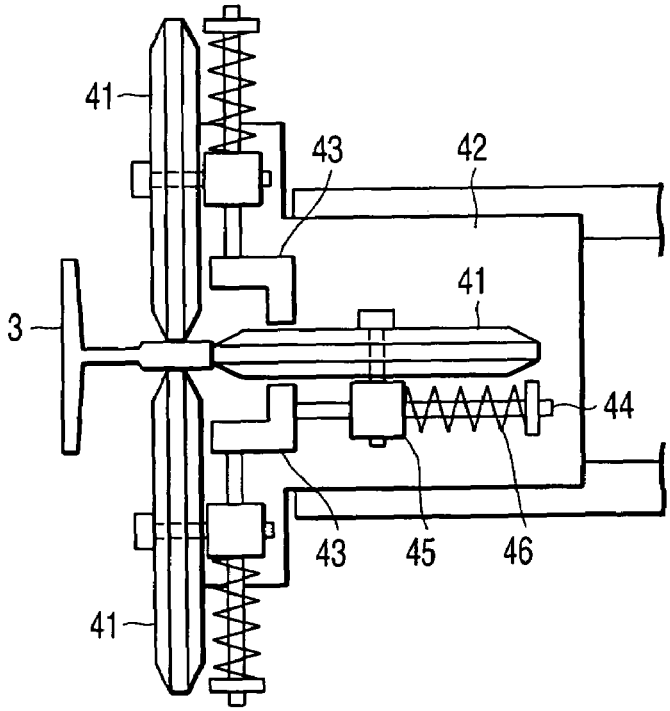
FIG. 7 is a plan view specifically showing the examples of each active guide mechanism 40 and each guiding device 100 in the elevator according to the second embodiment of the present invention.

FIG. 6 is a side view specifically showing examples of each of the active guide mechanisms 40 and each of the guiding devices 100 in the elevator according to the second embodiment of the present invention. FIG. 7 is a plan view specifically showing the examples of each active guide mechanism 40 and each guiding device 100 in the elevator according to the second embodiment of the present invention.

Each active guide mechanism 40, as shown in FIGS. 6 and 7, comprises three rollers 41, an attachment plate member 42, fixing and supporting members 43, bar-shaped guide rollers 44, supporting block members 45, elastic members 46 and displacement sensors 47. The rollers 41 are arranged in such a way as to press the guide rail 3 from three directions, respectively. The attachment plate member 42 is fixed to, e.g., a supporting member 16 for the electromagnet 11 (see FIG. 6) or a car structural member located to close to the supporting members 16. The fixing and supporting members 43 are provided upright on the attachment plate member 42, and are also arranged to face each other. Each of them is a member having, e.g., an L-shaped cross section.

The bar-shaped guide members 44 are members projected from the fixing and supporting members 43 in parallel with the rollers 41, respectively. The supporting block members 45 are movably engaged with the guide members 44, the elastic members 46 supporting the rollers 41 such that the rollers 41 are rotatable are, e.g., springs, and operate to make the supporting block members 45 press the rollers 41 against the guide rail 3. The displacement sensors 47 detect warping of the elastic members 46.

The supporting block members 45 may be mere block members. For example, as shown in FIG. 6, they may be provided such that their lower end portions are fitted in grooves formed in side walls of the attachment plate member or grooves provided in the attachment plate members 42.

In each of the guiding devices 100 shown in FIG. 5, in a material-strength model 22, a section secondary moment of the guide rail 3, the modulus of elasticity of the guide rail 3 and information regarding the distance between fulcrums, etc. are stored as in the guiding device 100 shown in FIG. 1, and also, in a rail-warp information storing and outputting section 23, the amount of warping of the guide rail 3 at the rail setting time is stored.

Figure 8:
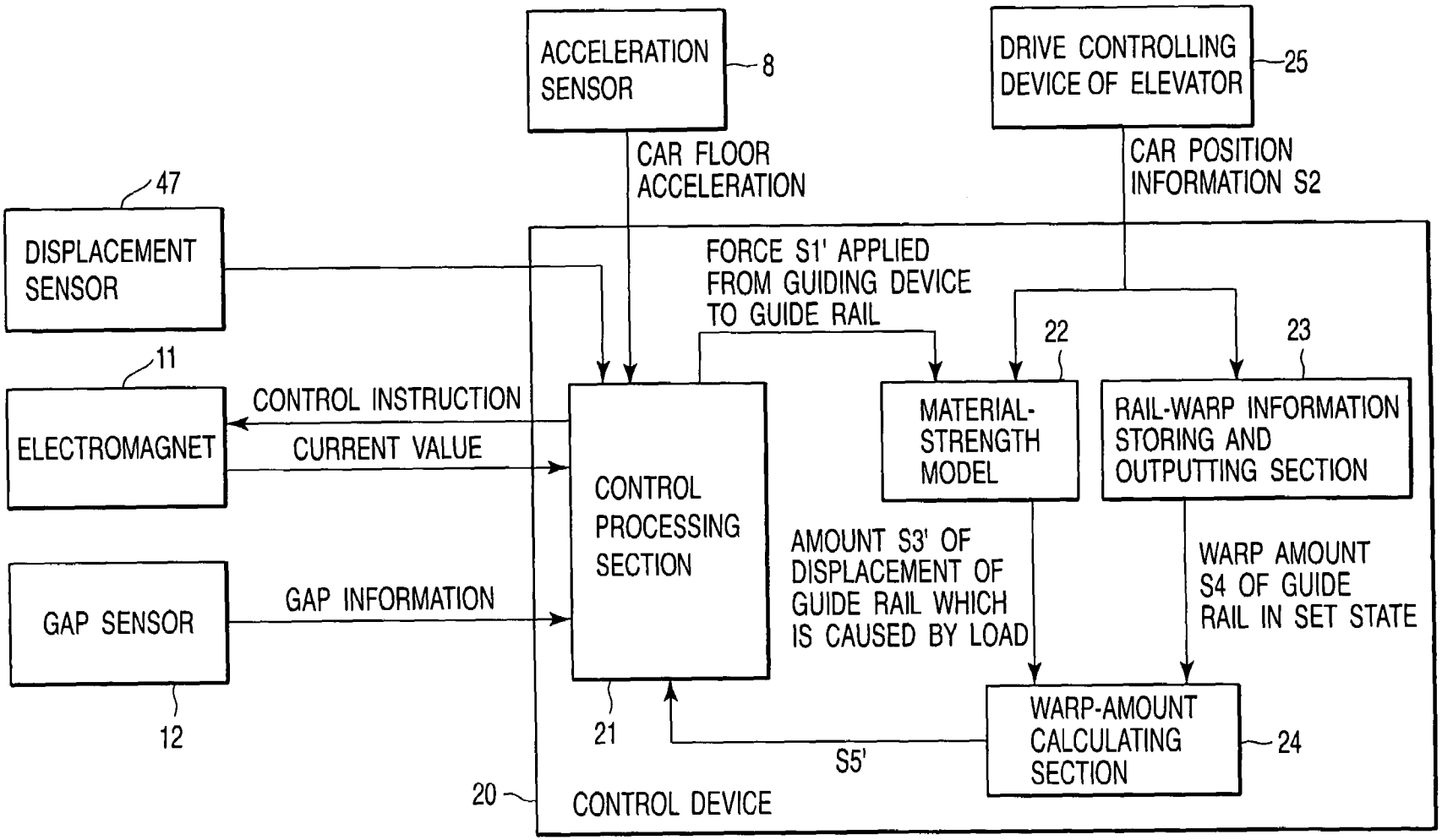
FIG. 8 is a block diagram of structural examples of various devices provided in each guiding device 100 in the elevator according to the second embodiment of the present invention.

FIG. 8 is a block diagram of structural examples of various devices provided in each guiding device 100 in the elevator according to the second embodiment of the present invention.

When the car 2 is operated, as shown in FIG. 8, a control processing section 21 of the control device 20 calculates the force applied to the guide rail 3 from the electromagnet 11 based on current flowing in the electromagnet 11 and gap information regarding the gaps measured by the gap sensors 12. Also, the control processing section 21 calculates the force applied to the guide rail 3 from the elastic members 46 through the roller 41. From those two forces applied to the guide rail 3, the force S1' applied to the guide rail 3 from the active guide mechanisms 40 is calculated, and information regarding the force is send to a material-strength model 22.

To the material-strength model 22, present position information S2 regarding the present position of the car 2 is input from a drive controlling device 25 of the elevator. Thus, the material-strength model 22 performs a operation to calculate the amount S3' of displacement of the guide rail 3 in the present position of the active guide mechanism 40, which is caused by a load, according to the model type of the strength of materials, by using the present position information S2 regarding the car 2, the force S1' applied to the guide rail 3 and the stored section secondary moment of the guide rail 3, modulus of the elasticity and information regarding the distance between the fulcrums. It then outputs the obtained information to a warp-amount calculating section 24.

On the other hand, the present position information S2 regarding the car 2 is momently input from the drive controlling device 25 to the rail-warp information storing and outputting section 23. Thus, the rail-warp information storing and outputting section 23 reads out the warp amount S4 at the rail setting time, which corresponds to the present position information S2, and sends it to the warp-amount calculating section 24. The warp-amount calculating section 24 calculates the warp amount S5' of the guide rail 3 which is the sum of the amount S3' of displace-ment of the guide rail 3, which is caused by the load, and the warp amount S4 in the present car position, and then outputs the result of calculation to the control processing section 21. The control processing section 21 gives the electromagnet 11 a control instruction according with the warp amount S5' input from the warp-amount calculating section 24, thereby controlling the magnetic force of the electromagnet 11.

As explained above, in the elevator according to the second embodiment of the present invention, the warp amount of the guide rail 3 is absorbed by expansion and contraction of the elastic members 46, thus reducing a lateral external force applied to the car 2, and the external force is further reduced by controlling the attraction of the electromagnet 11, or vibration occurring at the car 2 is restricted. As a result, the motion of the car 2 can be reduced.

Furthermore, in the elevator according to the second embodiment of the present invention, the magnetic force of the electromagnet 11 is controlled based on the warp amount S5' of the guide rail 3 which is the sum of the amount S3' of displacement of the guide rail 3 which is caused by the load and the warp amount S4 of the rail which corresponds to the present car position at the rail setting time. That is, the magnetic force of the electromagnet 11 is controlled, after the absolute position of the car 2 in the horizontal direction is detected in addition to the relative position of the car 2 to the guide rail 3. Thus, the position of the car 2 in the horizontal direction can be always kept fixed. Thus, an elevator can be achieved which does not cause vibration, and which is good with respect to riding comfort.

Moreover, in the elevator according to the second embodiment of the present invention, a feedforward control is performed, and thus a small magnetic force is used, as in the elevator according to the first embodiment, thereby always keeping the position of the car 2 in the horizontal direction fixed.

In addition, in the elevator according to the second embodiment of the present invention, an acceleration sensor 8 is provided, and the control is combined with a feedback control using an output signal of the sensor 8, as in the elevator according to the first embodiment, whereby vibration of the car 2 can be further reduced. Thus, the achieved elevator further improves the riding comfort.

The Third Embodiment

In an elevator according to the third embodiment of the present invention, load detecting sensors 10 are provided as units for detecting reaction forces between guide rails 3 and guiding devices 100, in four positions under the floor of the car room 5 as shown in FIGS. 1 and 5. The results of detections by the load detecting sensors 10 are output to a control processing section 21, and the control processing section 21 can calculates the total force of the balance (moment) of the car 2 itself and the balance (moment) given to the car 2 by a tail cord 9 and a compensating rope 7 in the present car position, i.e., it can calculate the variation of the reaction force between the guide rail 3 and the guiding device 100, based on information regarding the load, which is detected by the load detecting sensor 10. The control processing section 21 may be set to calculate the force applied to the guide rail 3 from an electromagnet 11 based on the variation of the calculated reaction force, current flowing in the electromagnets 11 and information regarding gaps measured by gap sensors 12.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A guiding device of an elevator, which is provided at a car to be made to ascend/descend in a hoistway, for guiding the car along guide rails arranged on both sides of the hoistway, the guiding device comprising:

a non-contact type of actuator configured to generate a magnetic force which keeps the actuator away from surfaces of a guide rail by predetermined distances;

a distance detecting unit configured to detect a distance between the guide rail and the car;

a unit configured to determine an amount of displacement of the guide rail which is caused by a load which generates at time of guiding the car, based on a value of the magnetic force generated by the actuator and the distance detected by the distance detecting unit;

a unit configured to acquire present position information regarding the car;

a unit configured to calculate an amount of a warp occurring at time of setting the guide rail, which corresponds to the acquired present position information; and a control unit configured to control the magnetic force generated by the actuator based on a total value of the determined amount of the displacement and the amount of the warp.

2. A guiding device of an elevator, which is provided at a car to be made to ascend/descend in a hoistway, for guiding the car along guide rails arranged on both sides of the hoistway, the guiding devices comprising:

a non-contact type of actuator configured to generate a magnetic force which keeps the actuator away from surfaces of a guide rail by predetermined distances;

a distance detecting unit configured to detect a distance between the guide rail and the car;

an active guide mechanism which includes units configured to press respective rollers against the surfaces of the guide rail by using elastic forces of elastic members, and displacement detecting units configured to detect displacement of the elastic members;

a unit configured to determine an amount of displacement of the guide rail which is caused by a load, based on a value of the magnetic force generated by the actuator, the distance detected by the distance detecting unit, and amounts of the displacement detected by the displacement detecting units;

a unit configured to acquire present position information regarding the car;

a unit configured to calculate an amount of a warp occurring at time of setting the guide rail, which corresponds to the acquired present position information; and a control unit configured to control the magnetic force generated by the actuator based on a total value of the amount of the displacement and the amount of the warp.

3. The guiding device of the elevator, according to claim 1, wherein the non-contact type of actuator is a magnet which varies an attraction for the guide rail by using the generated magnetic force controlled by the control unit, to keep away from the surfaces of the guide rail at the predetermined distances.

4. The guiding device of the elevator, according to claim 2, wherein the non-contact type of actuator is a magnet which varies an attraction for the guide rail by using the generated magnetic force controlled by the control unit, to keep away from the surfaces of the guide rail at the predetermined distances.

5. The guiding device of the elevator, according to claim 1, wherein the unit configured to determine the amount of the displacement is a material-strength model of the guide rail, which calculates the amount of the displacement of the guide rail, which is caused by the load generating at the time of guiding the car, based on the value of the magnetic force generated by the actuator, the distance detected by the distance detecting unit, and predetermined parameters.

6. The guiding device of the elevator, according to claim 2, wherein the unit configured to determine the amount of the displacement is a material-strength model of the guide rail, which calculates the amount of the displacement of the guide rail, which is caused by the load generating at the time of guiding the car, based on the value of the magnetic force generated by the actuator, the distance detected by the distance detecting unit, and predetermined parameters.

7. The guiding device of the elevator, according to claim 1, wherein an acceleration sensor configured to detect a variation of a speed of the car with time in a horizontal direction is provided in a desired position of the car, and the control unit feedback-controls the magnetic force generated by the actuator based on the value of the variation detected by the acceleration sensor.

8. The guiding device of the elevator, according to claim 2, wherein an acceleration sensor configured to detect a variation of a speed of the car with time in a horizontal direction is provided in a desired position of the car, and the control unit feedback-controls the magnetic force generated by the actuator based on the value of the variation detected by the acceleration sensor.

9. The guiding device of the elevator, according to claim 1, wherein a load detecting unit configured to detect a reaction force against the guide rail is provided under the car.

10. The guiding device of the elevator, according to claim 2, wherein a load detecting unit configured to detect a reaction force against the guide rail is provided under the car.

11. The guiding device of the elevator, according to claim 9, wherein the reaction force detected by the load detecting unit is a combination of a moment of the car itself and a moment given to the car by a compensating rope and a tail cord, which is obtained from the position information regarding the car.

12. The guiding device of the elevator, according to claim 10, wherein the reaction force detected by the load detecting unit is a combination of a moment of the car itself and a moment given to the car by a compensating rope and a tail cord, which is obtained from the position information regarding the car.

* * * * *